United States Patent [19]

Norman

[11] 4,047,250

[45] Sept. 13, 1977

[54] CONTOURED WRIST SUPPORT

[76] Inventor: Bill Norman, 14431 Galy, Tustin, Calif. 92680

[21] Appl. No.: 731,511

[22] Filed: Oct. 12, 1976

[51] Int. Cl.[2] ..... A11D 19/00

[52] U.S. Cl. ..... 2/161 A; 128/165; 273/54 B; 2/16; 2/170

[58] Field of Search ..... 2/16, 159, 161 R, 161 A, 2/170; 273/54 B, 189 A, 89 R; D2/361; 128/89 R, 165

[56] References Cited

U.S. PATENT DOCUMENTS

| | | | |
|---|---|---|---|
| 2,794,638 | 6/1957 | Risher et al. | 273/54 B |
| 2,924,458 | 2/1960 | Barry | 273/54 B |
| 3,117,786 | 1/1964 | Anderson | 2/16 X |
| 3,728,738 | 4/1973 | Andolino | 2/161 A |
| 3,779,550 | 12/1973 | Bempun | 2/161 A X |
| 3,790,168 | 2/1974 | Hashimoto | 273/54 B |
| D. 239,220 | 3/1976 | Norman | D2/361 |

*Primary Examiner*—G. V. Larkin

*Attorney, Agent, or Firm*—Gausewitz, Carr & Rothenberg

[57] ABSTRACT

This invention provides a contoured wrist support that includes a sheet portion adapted to be wrapped around the wrist, the sheet portion being made up of more than one element having contoured edges stitched together so as to provide it with a three-dimensional shape, the sheet portion having a cushioning lining and pockets for receiving three reinforcing members. One of the reinforcing members is rigid and complementarily overlies the back of the hand and wrist. A second reinforcing member is generally rigid but can be deflected slightly by hand and complementarily overlies the palm of the hand and inside of the wrist. The third reinforcing member, between the first and second reinforcing members, is positioned along the outer side edge of the hand and wrist and made of malleable material so that it can be deflected by the user to assume the contour of his hand and wrist.

31 Claims, 14 Drawing Figures

FIG. 9.
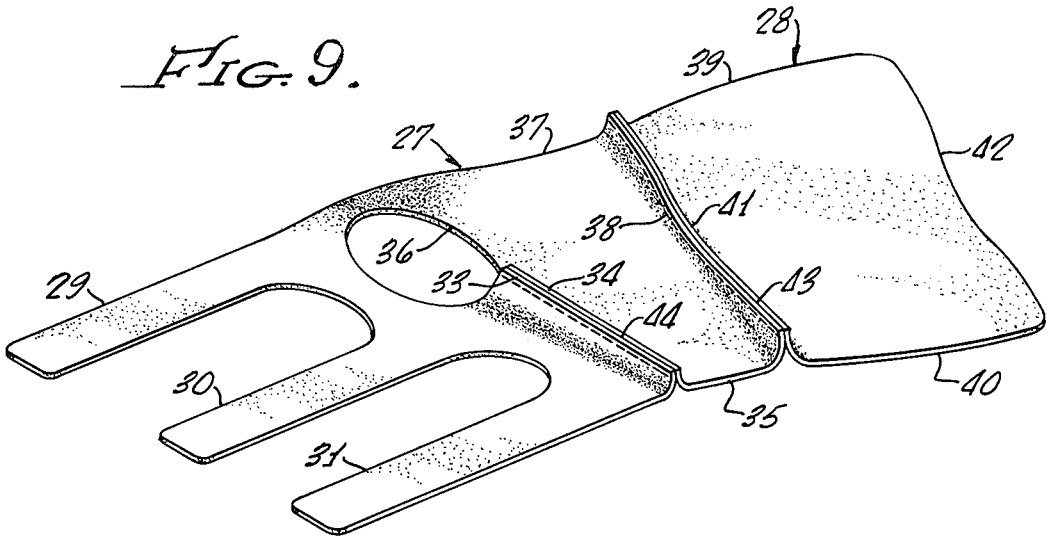
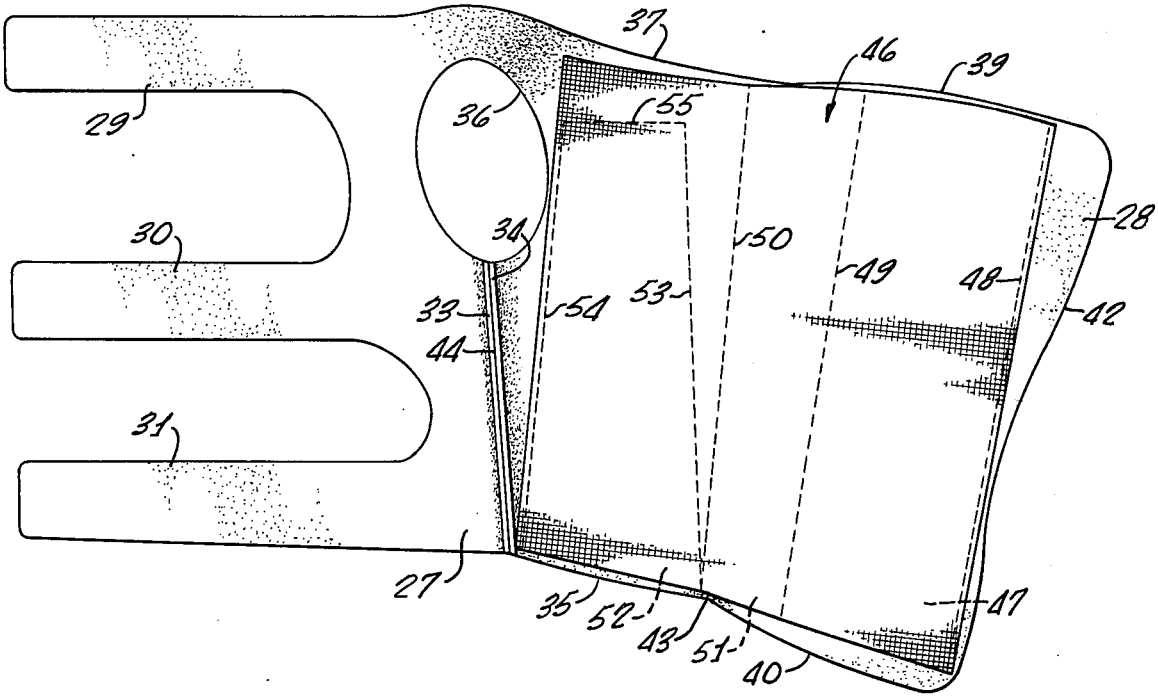
FIG. 10.
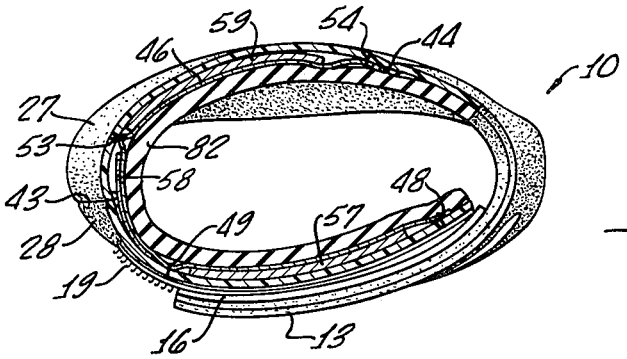
FIG. 6.

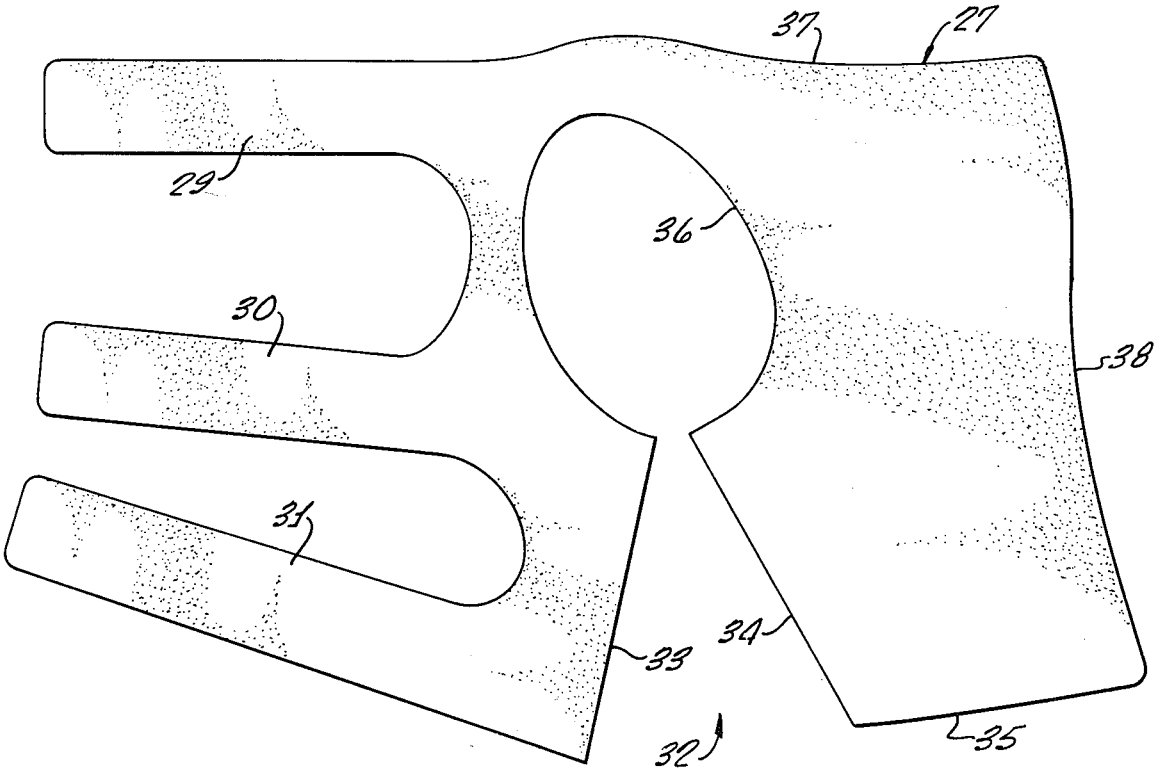
FIG. 7.
FIG. 8.
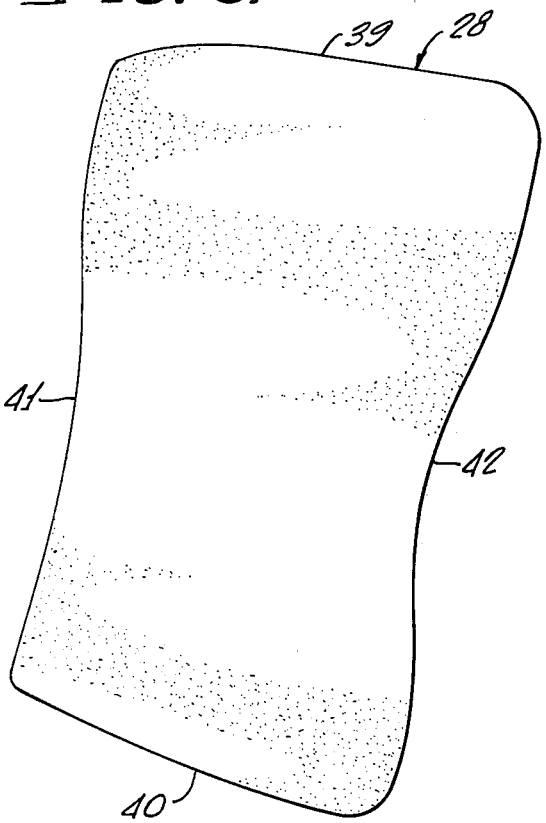
FIG. 12.
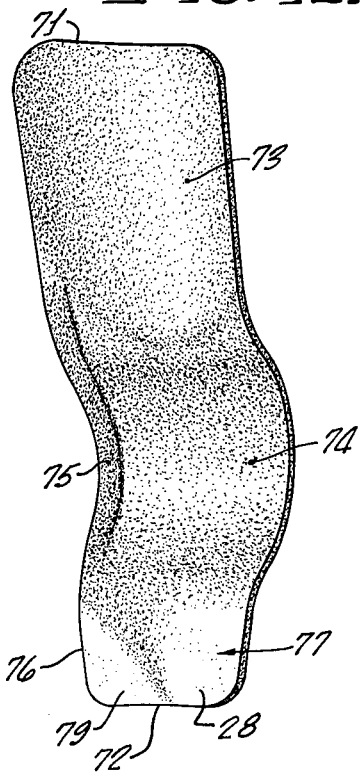

CONTOURED WRIST SUPPORT

BACKGROUND OF THE INVENTION:

1. Field of the Invention

This invention relates to a wrist support for bowling.

2. Description of the Prior Art

It is well known that in bowling the wrist must be held against movement rearwardly or inwardly or outwardly if accuracy is to be obtained. Consequently, there have been many efforts toward devising wrist supports for preventing bowlers from experiencing undesirable wrist movement. Some types of these devices amount to little more than a sheet of pliable material fastened around the wrist area. Effective wrist bracing is impossible with such devices because the pliable material cannot prevent wrist movement no matter how tightly it is secured around the wrist. Other devices have incorporated reinforcing elements in an effort to hold the wrist more rigidly. However, many of these reinforcements have not been such as to prevent wrist movement in all directions that are harmful to the accuracy of the bowling movement. Moreover, prior reinforced wrist supports have incorporated metal elements of arbitrary contours, lacking the shapes of the portions of the anatomy they are intended to brace, resulting in discomfort after a relatively short time. The bowler needs to wear the wrist support for prolonged periods, and prior reinforced wrist support devices have not allowed this without frequent instances of discomfort to the bowler.

SUMMARY OF THE INVENTION

The present invention provides an improved wrist support device contoured to be complementary to the portions of the hand and wrist that it engages, effectively blocking all undesirable types of wrist movement during bowling, while affording complete comfort to the bowler no matter how long the device is worn. The outer portion of the device is made up of sheet material, such as fabric reinforced polyvinylchloride, which is in at least two sections. These two sections are sewn together along contoured edges that have concave portions which oriduces a three-dimensional shape in the assembly. One of the sections includes a thumb opening with a wedge-shaped notch extending to it from an edge of the sheet member. The edges of the notch are sewn together, thereby further imparting as desirable three-dimensional shape to the device so that it will assume the contour of the hand and writst around which it extends. Straps extend from one end of the assembly with fastening elements on the ends of the straps as well as on one of the sheet members for securing the unit around the bowler's wrist.

Reinforcement is provided by three reinforcing members which are received in pockets provided in the sheet members. One of the reinforcing members fits over the palm of the hand and the inside of the wrist to prevent inward wrist movement. This reinforcing member is given a compound curvature which follows the normal anatomy of this portion of the hand and wrist. It is made semirigid so that it can be deflected slightly in contour if this should be necessary. Another of the reinforcing members overlies the back of the hand and the wrist, with a notch in one side receiving the projecting wrist bone. This reinforcing member is of rigid material not normally bendable by hand, having a contour that universally approximates that of the back of the hand and wrist. The third reinforcing element is of malleable material and bendable by hand. It is positioned between the other two reinforcing members and prevents the hand and wrist from pivoting to the side. The user of the wrist support bends the member to fit the exact shape of the side edge of his hand and wrist. Once given this contour it retains it against the forces normally imposed upon it as the device is used in bowling. It is possible to eliminate the third reinforcement and still obtain effective wrist bracing. However, the use of the third reinforcement provides significantly improved support and performance.

The presence of the three reinforcing elements provides greater rigidity and bracing of the wrist than is possible with ordinary wrist supporting devices. The contouring of the reinforcing members, as well as the flexible sheet with which they are associated, not only allows the support to more effectively brace the wrist against movement, but also assures that there are no parts to dig in and cause discomfort to the person wearing the device. These very desirable objectives are provided in a device that has a neat and attractive appearance and is adapted to mass production techniques.

BRIEF DESCRIPTION OF THE DRAWINGS

FIG. 6 is a transverse sectional view, taken along line 6—6 of FIG. 4;

FIG. 7 is a plan view of one of the sheet members used in producing the wrist support;

FIG. 8 is a plan view of an additional sheet member used in forming the wrist support;

FIG. 9 is a perspective view of the wrist support in a partially assembled condition;

FIG. 10 is a plan view of the wrist support after an additional step in its manufacture;

FIG. 12 is a perspective view of one of the reinforcing elements showing it from a different angle from that of FIG. 11 so that its concave side can be seen;

Figure 2:
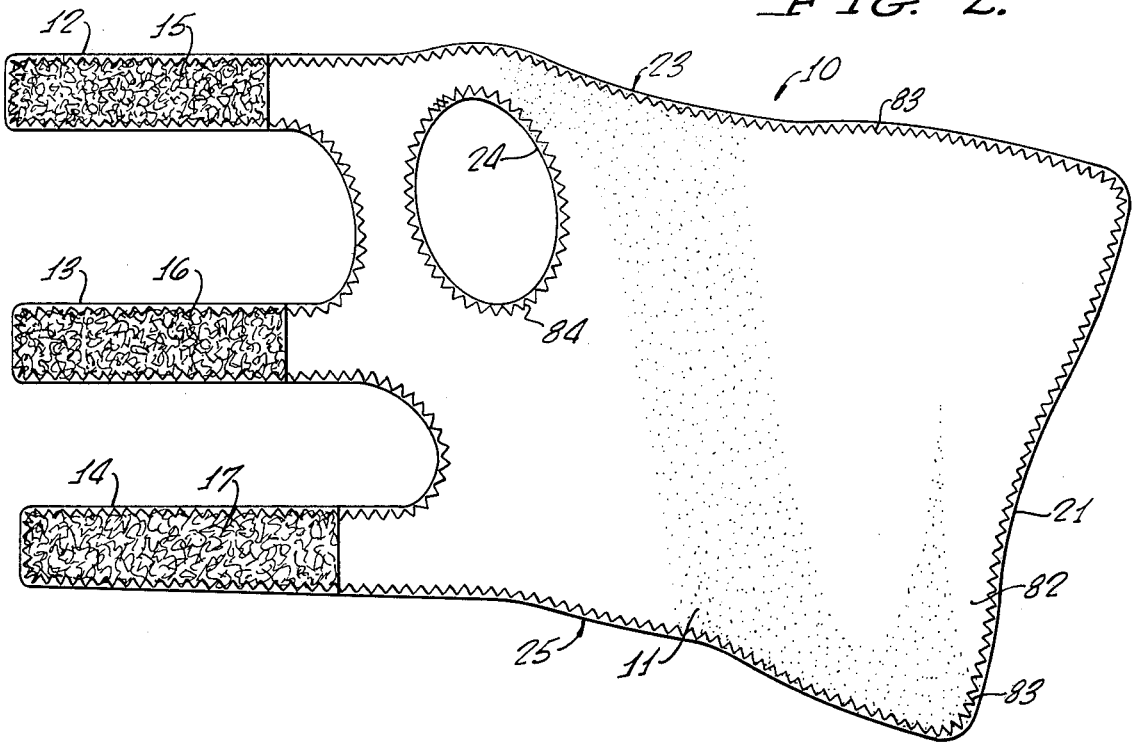
FIG. 2 is a plan view of the wrist support as seen from the inside.
Figure 1:
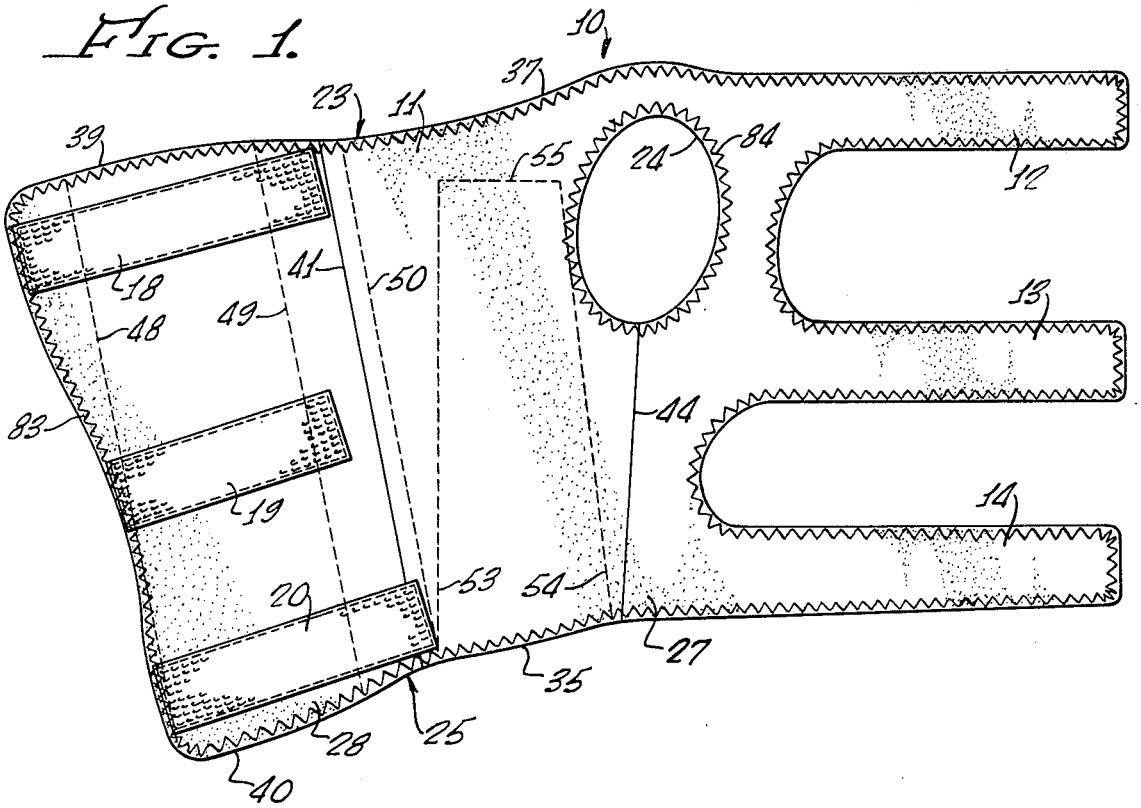
FIG. 1 is a plan view of the wrist support of this invention, viewed from the outside.
Figure 3:
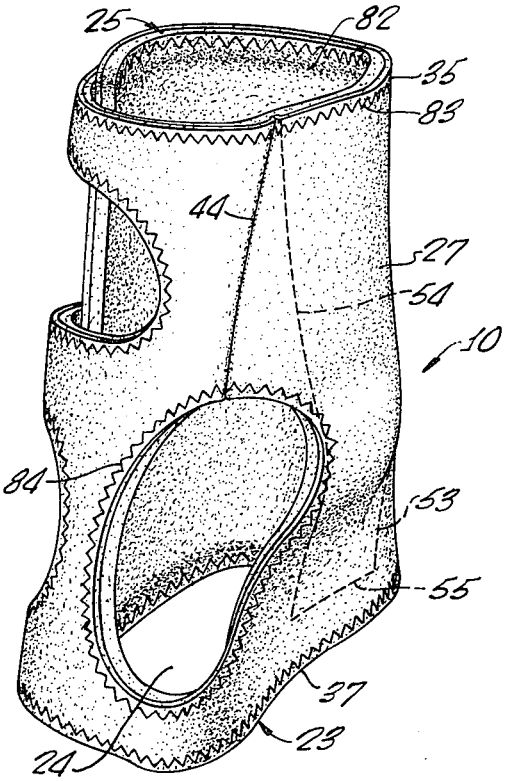
FIG. 3 is a perspective view of the wrist support in the secured position.

DESCRIPTION OF THE PREFERRED EMBODIMENT:

The wrist support 10, as shown in FIGS. 1 and 2, includes a principal portion 11 from one end of which projects three parallel straps 12, 13 and 14. The spacing between the strap 12 on one side and the center strap 13 is greater than that between the strap 13 and the strap 14 on the other side. On the inside surfaces of the straps 12, 13 and 14, shown in plan in FIG. 2, are fastening elements 15, 16 and 17, respectively. These are adapted to mate with fastening elements 18, 19 and 20 on the outside of the wrist support, extending inwardly in a parallel relationship from the end 21 opposite from the straps. Preferably, the fastening elements are of the hook and pile type marketed under the trademark velcro, with the pile portions being on the straps and the hook elements used for the fastening portions 18, 19 and 20 on the principal portion 11 of the wrist support.

Adjacent the side edge 23 of the wrist support (the upper edge as shown in FIGS. 1 and 2) and near the inner ends of the straps 12 and 13 is an opening 24 which receives the thumb when the wrist support is in use. The opening 24 is elongated in a direction extending between the edge 23 and the opposite edge 25 of the wrist support.

The device is used by extending the thumb through the opening 24 with the principal portion 11 of the support then being wrapped around the wrist and hand and the straps secured to the fastenings 18, 19 and 20. In this way, the wrist support extends from the palm of the hand and inside of the wrist over the outer edge of the wrist to the back of the hand and wrist, providing effective reinforcement against bending.

The construction of the wrist support of this invention enables it not only to rigidly brace the wrist, but also to achieve this with maximum comfort. In achieving this result in the manufacture of the device, there are provided flexible sheet members 27 and 28, as shown in FIGS. 7 and 8, preferably made of strong material with limited stretch, such as fabric-reinforced polyvinylchloride. The member 27 includes three elongated projecting portions 29, 30 and 31 which are used in making the straps 12, 13 and 14 in the completed unit. However, as cut from a flat sheet, they are not parallel, as are the straps 12, 13 and 14. That is to say, there is a slight convergence outwardly for the straps 29 and 30, and the strap 31, shown at the lower edge of FIG. 7, approaches the strap 30 at an even greater angle. The sheet 27 includes a wedge-shaped notch 32 defined by edges 33 and 34 that converge inwardly from the lower edge 35 of the sheet 27. The inner end of the notch 32 communicates with an elongated opening 36 which is used in producing the opening 24 of the completed unit, but which is not closed at the location where it joins the wedge-shaped notch 32, and hence is slightly wider than the final opening 24.

The edge 37 of the sheet 27, positioned at the top in FIG. 7, has a curved configuration, including an elevated portion over the location of the opening 36. The end edge 38 opposite from the projections 29, 30 and 31 also is curved, being slightly convex at its upper portion, as illustrated in FIG. 7, but concave in its intermediate region.

The member 28 includes upper and lower edges 39 and 40, respectively, as illustrated, which diverge from the end edge 41, shown at the left, to the opposite end edge 42. The upper part of the end edge 41 is curved to a slightly convex configuration with the intermediate portion of this edge being concave. The opposite edge 42 has a concave central region.

The members 27 and 28 are sewn together along their edges 38 and 41, respectively, producing a plain seam 43. Also, the two opposite edges 33 and 34 of the notch 31 are sewn together to form a plain seam 44 so that an assembly as shown in FIG. 9 is produced. By virtue of the edge contours of the seams, the unit no longer lies flat. The edges 38 and 41 of the members 27 and 28, being concave in their intermediate parts, cause the assembled unit to assume a three-dimensional configuration, elevated at the ends of the seam 43 when the inside surface is viewed as in FIG. 9. Also, the seam 44 connecting the edges 32 and 33 of the member 27 not only imparts a contour to the assembly but also straightens out the protrusions 29, 30 and 31. The latter elements become substantially parallel in the assembly of FIG. 9, just as are the straps 12, 13 and 14 of the completed wrist support 10.

In the assembly shown in FIG. 9, the fastening elements 18, 19 and 20 are stitched to the outer surface of the member 28.

A sheet of material 46 is secured to the inside of the assembled members 27 and 28, as shown in FIG. 10. The material 46 has roughly the contour of the portions of the sheets 27 and 28 beyond the opening 36, although its outer edges do not extend entirely to the outer edges of the members 27 and 28. The sheet 46 is sewn to the members 27 and 28 to form three pockets which are usd subsequently for receiving reinforcing members. A first pocket 47 results from the connection of the sheet 46 to the member 28 by substantially parallel rows of stitches 48 and 49 extending between the edges 39 and 40, with stitching 47 being adjacent the end edge 42. An additional row of stitches 50 connects the sheet 46 to the member 27 just beyond the seam 43. The stitches 50 are substantially parallel to the row of stitches 49 and closer to the stitches 49 than the row of stitches 48. This pocket 51, therefore, is slightly narrower than the one first described, and shorter because it is adjacent the edge 41 of the sheet member 28.

A third pocket 52 is provided through rows of stitches 53 and 54 that connect the sheet 46 to the member 27, with an interconnecting inner row of stitches 55 to give the pocket a closed end. The row of stitches 53 commences at the edge 35 of the sheet 27 adjacent the row of stitches 50, but diverges from the row 50 inwardly of the edge 35. The opposite row of stitches 54 is at the left-hand edge of the sheet 46, as illustrated, and is generally parallel to the rows 48, 49 and 50. Consequently, the pocket 52 defined by the stitches 53, 54 and 55 is convergent inwardly and is the shortest of the three pockets.

Figure 11:
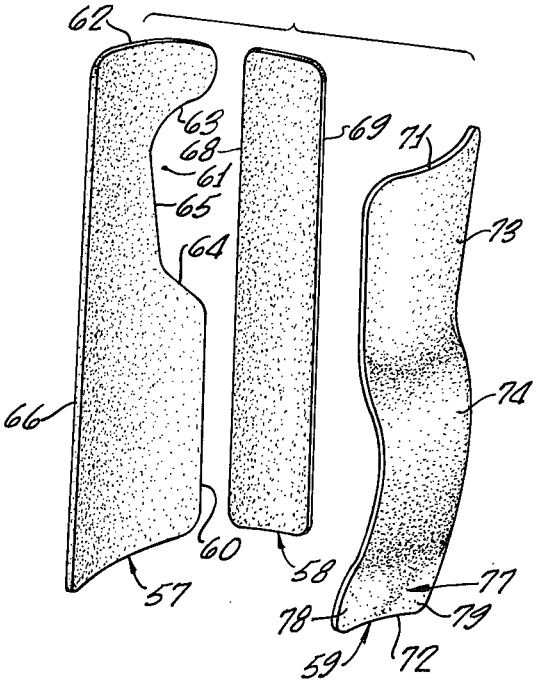
FIG. 11 is a perspective view of the three reinforcing elements of the wrist support.
Figure 4:
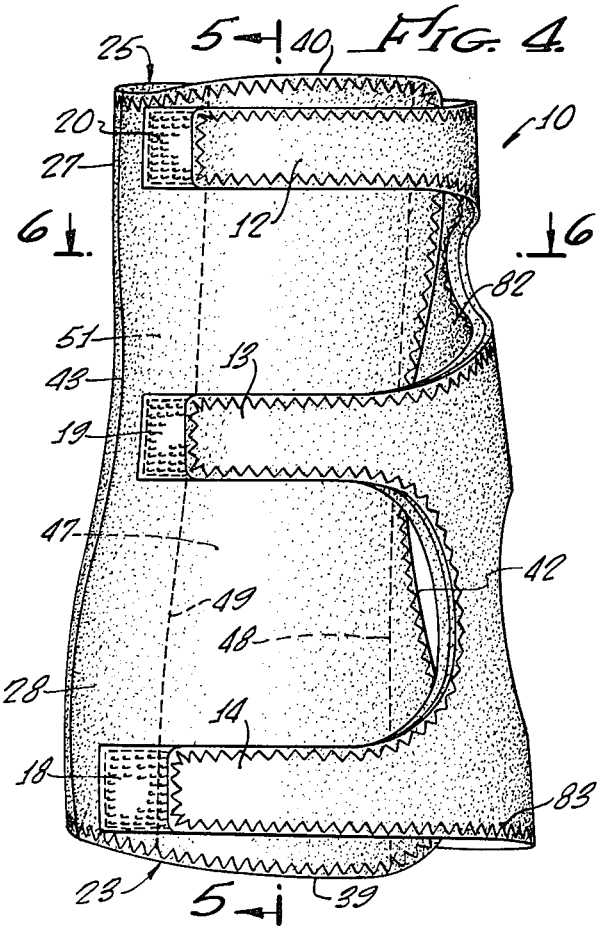
FIG. 4 is an elevational view of the wrist support in the secured position.
Figure 5:
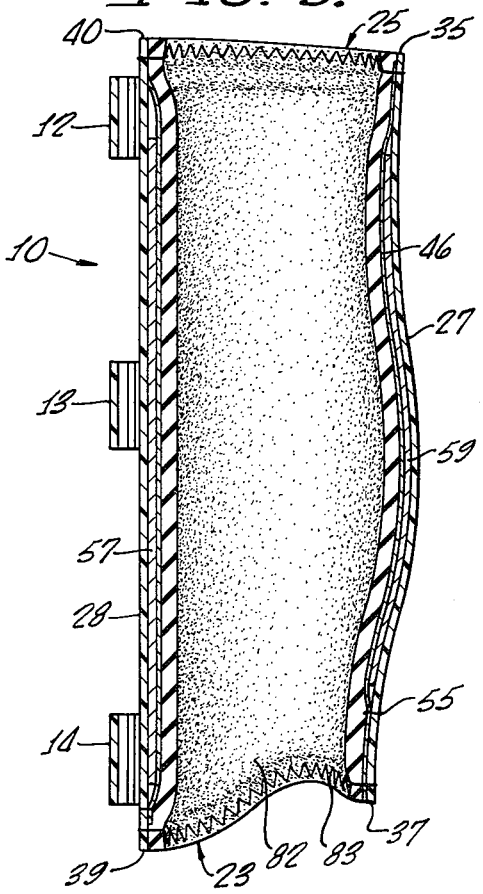
FIG. 5 is a longitudinal sectional view, taken along line 5—5 of FIG. 4.

The three reinforcing members 57, 58 and 59 are shown in FIG. 11, with FIG. 12 showing additionally an enlarged perspective illustration of the side of the reinforcement 59 opposite from that shown in FIG. 11.

The member 57, the longest of the reinforcements, is of relatively heavy gauge so that it maintains its configuration and is not normally bendable by hand. It is arcuate in cross section, having a shallow curvature but bent a little more sharply adjacent one side edge 60. This edge is provided with an elongated notch 61 adjacent one end 62 of the member 57, the notch 61 having inclined side portions 63 and 64 with a straight inner edge 65 that inclines inwardly toward the side edge 66 of the member 57. Thus, the edge 65 of the notch 61 is convergent with the generally straight-side edge 66 of the member 57 opposite from the edge 60.

The member 57 fits within the pocket 47 defined by the stitches 48 and 49 with its end edge 62 adjacent the edge 40 of the member 28. It is positioned so that its concave surface is on the inside of the wrist support assembly. The member 57 provides the reinforcement for the back of the hand and wrist during use of the wrist support.

The reinforcement 58, of intermediate length, is of considerably lighter gauge than the reinforcement 57 and is of material having some malleability. Consequently, it is possible for the user of the wrist support to vary the contour of the member 58. However, as supplied when the wrist support is manufactured, the member 58 is straight in the longitudinal direction, having parallel elongated side edges 68 and 69 with an arcuate contour intermediate these edges. The reinforcement 58 is dimensioned to fit within the narrow pocket 51 between the rows of stitches 49 and 50 with its concave surface facing inwardly. This reinforcement is adjacent and parallel to the reinforcement 57, fitting over the side edge of the hand and wrist when the device is in use.

The third and shortest reinforcement 59 is slightly convergent in width between its end edge 71, shown at the top in the illustrations of FIGS. 11 and 12, and the opposite end edge 72. This member is of compound curvature. Adjacent the upper edge 71, the portion 73 of the member 59 is arcuate in cross section having a substantially constant radius of curvature with an axis longitudinal of the member 59. Intermediate its ends, the portion 74 of the member 59 is curved about a transverse axis, thus having an axis of curvature generally perpendicular to that of the section 73. In transverse cross section, the intermediate portion 74 is generally straight with the exception of an inwardly extending flange portion 75 along one side edge 76 of the reinforcement.

Beneath the portion 74, as the reinforcement 59 is illustrated, the section 77 that extends to the edge 72 is made up of two substantially flat portions 78 and 79. The latter part is slightly smaller than the portion 78 and inclines outwardly at a shallow angle away from the concave side of the reinforcement 59. The portion 78 is substantially in a plane transverse to the reinforcement 59.

The pocket 52 defined by the rows of stitches 53, 54 and 55 recives the reinforcement 59 with the narrower end 72 at the inner end of the pocket next to the stitches 55. Thus, the end section 77 and intermediate portion 74 are located at one side of the thumb opening 24 with the transversely curved portion 73 spaced from the opening. The pocket 52 positions the reinforcement 59 next to the reinforcement 58 at a shallow angle to the latter reinforcement. The concave side of the reinforcement 59 is on the inside of the wrist support.

The member 59 is of a gauge intermediate that of the reinforcements 57 and 58. Consequently, the member 59 is substantially rigid but is capable of some deflection to achieve minor variations in its contour.

With the reinforcements 57, 58 and 59 received in their pockets, the wrist support is completed by attaching a lining 82 to the inside of the unit. The lining 82 is made of a resilient cushioning material such as fabric-faced foam plastic. A row of stitching 83 connects the lining 82 to the sheet members 27 and 28 around the perimeter of the assembly, with an additional row of stitching 84 attaching the lining 82 to the sheet 27 around the thumb opening. This not only attaches the lining to the sheet members 27 and 28, but also closes the ends of the pockets that receive the reinforcements 57, 58 and 59 so that these elements are permanently retained.

The wrist support then is ready for use, assuming the position shown in FIGS. 3–6. When secured around the wrist by the mating of the fasteners 15, 16 and 17 on the straps with the fasteners 18, 19 and 20, respectively, on the principal part 11, the device 10 locks against movement in three directions by virtue of the presence of the reinforcements 57, 58 and 59, preventing the types of wrist movement which detracts from an ability to bowl accurately. At the same time, the device is quite comfortable and can be worn for long periods of time without difficulty. This results because of the contour imparted to the assembled sheets 27 and 28 as well as the contours of the different reinforcements 57, 58 and 59.

Figure 13:
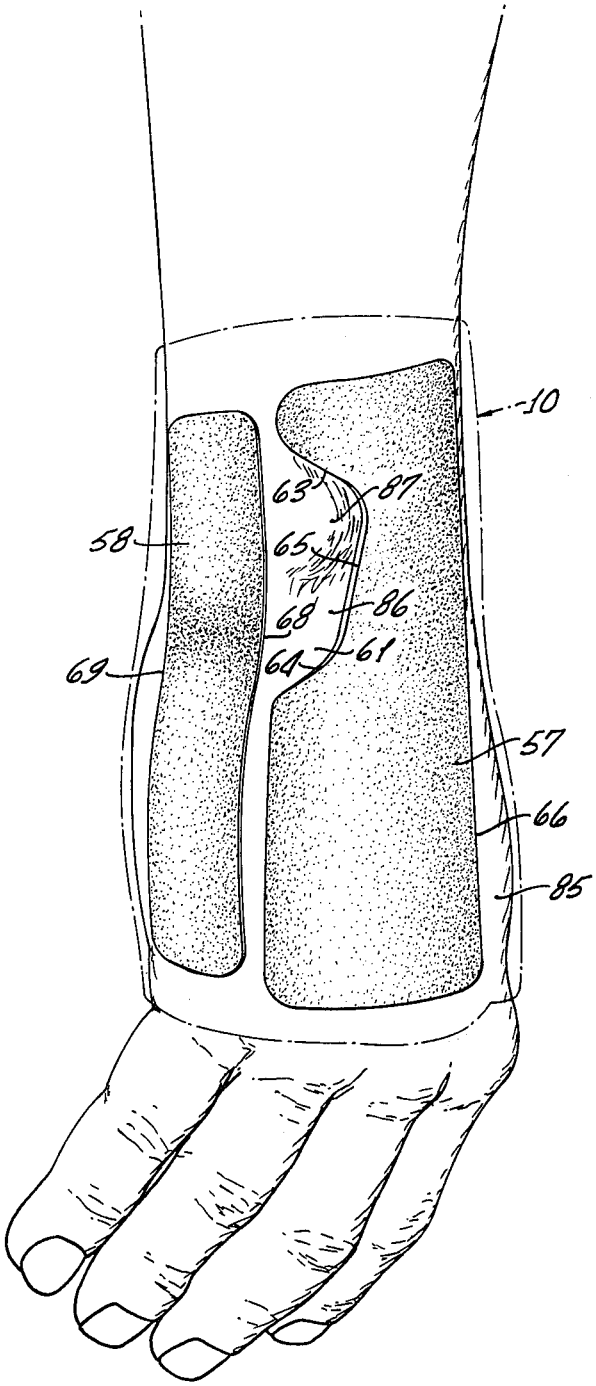
FIG. 13 is a perspective view illustrating how two of the reinforcing elements overlie the hand and wrist when the wrist support is in use.

Fitting over the back of the hand 85 and wrist 86, as seen in FIG. 13, the reinforcement 57 is of a curvature that is nearly complementary to these portions of the hand and wrist of virtually everyone who might wear the wrist support. The notch 61 receives the projecting bone 87 at the outside of the wrist and provides adequate clearance so that no metal bears against the bone. Because the reinforcement 57 is contoured to a universally appropriate shape and the considerable forces tending to bend the wrist outwardly during bowling, the member 57 is made of relatively heavy gauge material and is not of a deflectable nature.

The intermediate reinforcement 58, being malleable and bendable by hand, allows the wearer of the wrist support to contour this element to fit precisely the configuration of the cuter edge of this hand and wrist. This is necessary in enabling the member 58 to comply with the particular edge shape of the hand and wrist of the user. As shown in FIG. 13, the member 58 has been bent to shape and so is no longer straight longitudinally. When bent to the desired configuration, the member 58 withstands the magnitude of forces tending to bend the wrist to the side, as the support is used in bowling, thereby providing adequate locking of the wrist in that direction.

Figure 14:
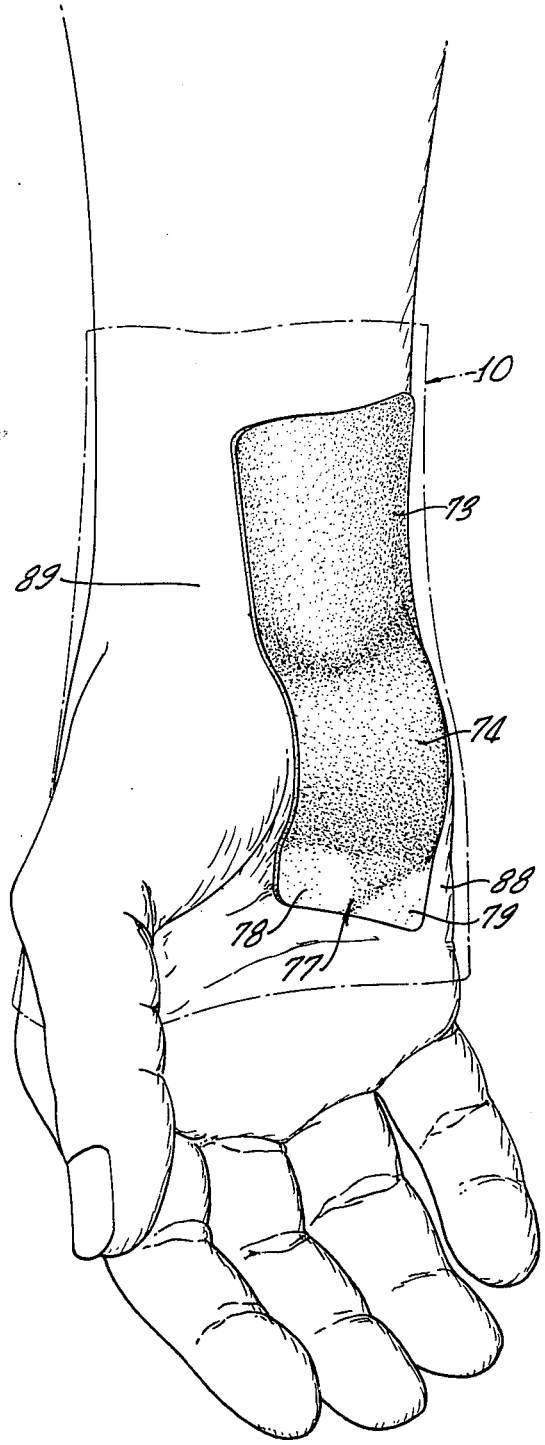
FIG. 14 is a perspective view showing how the third reinforcing element overlies the hand and wrist.

The third supporting element 59 is of very nearly universal configuration for complementarily overlying the palm of the hand 88 and inside of the wrist 89 of the user (see FIG. 14). The lower parts 78 and 79 of the member 59 fit within the central portion of the palm, with the angled part 79 following the contour at the outer portion of this region that inclines toward the edge of the plam. The reinforcement 59 reaches only the center of the palm, well short of where the hand bends at the knuckles. In this way it can brace the wrist effectively without interfering with movement of the fingers or causing discomfort upon such movement. Also, the portions 74 and 77 are relatively narrow so as to allow the thumb to move freely.

The intermediate palm, 74 of the member 59 extends over the heel of the paln adjacent the wrist and is complementary to this part of the anatomy. The side flange portion 75 extends just over the side edge of the plam, following the curvature of this region of the hand.

The portion 73 of the reinforcement 59 has the contour of the inside of the wrist over which it extends.

The member 59 has considerable rigidity, but is bendable by hand to make some small changes in its shape. Occasionally, this may be necessary in assuming a fit with maximum comfort for the person using the wrist support.

The sheet members 27 and 28 also follow the shape of the hand and wrist when wrapped around and secured. This comes about from the shapes of these members and the seams 43 and 44 that impart a three-dimensional contour. The concavity of the joined edges 38 and 41 of the members 27 and 28 gives the wrist support a minimum dimension at the narrowest part of the wrist, together with an ability to accommodate the larger adjacent hand and wrist portions.

The member 27 has a greater overall width at the thumb opening 24 so that it can extend through the crotch of the thumb, but is narrower at the location of the shorter reinforcement 59 so that thumb and finger movement is not impaired. The greater width of the device toward its end 21 allows it to accommodate the larger reinforcements 57 and 58 and extend a maximum distance over the back and side of the hand and wrist for effective reinforcement.

The close fit is enhanced by virtue of the kind of fastening elements used which can be mated at any overlapping portions of their lengths. Thus, each strap can be pulled as tight as desired.

The foregoing detailed description is to be clearly understood as given by way of illustration and example only, the spirit and scope of this invention being limited solely by the appended claims.

I claim:

1. A wrist support comprising flexible sheet means adapted to extend around portions of the hand and wrist of the user thereof, fastener means for holding said sheet means so extended around the hand and wrist, and reinforcement means for said sheet means, said reinforcement means including a first reinforcing member carried by a first portion of said sheet means for overlying portions of the palm of the hand and inner surface of the wrist, said first reinforcing member having a compound curvature such that it is substantially complementary to said portions of the palm of the hand and inner surface of the wrist, a second reinforcing member carried by a second portion of said sheet means for overlying portions of the back of the hand and wrist, said second reinforcing member being substantially straight longitudinally and curved transversely such that it is substantially complementary to said portions of the back of the hand and wrist, and a third reinforcing member carried by a third portion of said sheet means intermediate said first and second reinforcing members for overlying portions of the side edge of the hand and wrist.

2. A device as recited in claim 1 in which said third reinforcing member is relatively more malleable than said first and second reinforcing members and can be deflected by hand to a contour substantially complementary to said portions of the side edge of the hand and wrist.

3. A device as recited in claim 2 in which said third reinforcing member is curved transversely.

4. A device as recited in claim 3 in which said sheet means has opposite side edges, and said first, second and third reinforcing members extend in directions between said side edges, said side edges being more closely spaced adjacent said first reinforcing member than adjacent said second and third reinforcing members, said first reinforcing member being shorter than said second and third reinforcing members.

5. A device as recited in claim 4 in which said second reinforcing member is adjacent one end of said sheet means, said side edges of said sheet means diverging from adjacent said first reinforcing member to said one end of said sheet means.

6. A device as recited in claim 5 in which said sheet means has an opening therethrough for receiving the thumb, said opening being adjacent and to one side of said first reinforcing member, said first reinforcing member having a longitudinally curved portion and a transversely curved portion, said longitudinally curved portion being closer to said opening than is said transversely curved portion.

7. A device as recited in claim 6 in which said side edges are spaced further apart adjacent said opening than they are adjacent said first reinforcing member.

8. A wrist support comprising flexible sheet means adapted to extend around portions of the hand and wrist of the user thereof, said sheet means including an opening to receive the thumb, strap means extending from one end of said sheet means, fastener means on said strap means and said sheet means for holding said sheet means around the hand and wrist, and reinforcement means for said sheet means, said reinforcement means including a first reinforcing member carried by said sheet means adjacent said thumb opening, said first reinforcing member having a compound curvature such that it is contoured to be substantially complementary to portions of the palm of the hand and inner surface of the wrist for bracing against inward wrist movement, and a second reinforcing member carried by said sheet means at the opposite end of said sheet means, and said second reinforcing member being contoured to be substantially complementary to the back of the hand and outer surface of the wrist for bracing against outward wrist movement.

9. A device as recited in claim 8 in which said second reinforcing member is longer than said first reinforcing member.

10. A device as recited in claim 8 in which said second reinforcing member has a notch therein for receiving the wrist bone of the wearer of the wrist support, said second reinforcing member being sufficiently rigid to resist bending the same by hand.

11. A device as recited in claim 10 in which said second reinforcing member is an elongated sheet metal element curved transversely.

12. A device as recited in claim 8 in which said first reinforcing member is semirigid so as to allow bending by hand sufficient to make minor changes in the contour thereof.

13. A device as recited in claim 8 in which said first reinforcing member is an elongated sheet metal element generally concave on one side and convex on the other side, having a first portion curved transversely for causing the same to be substantially complementary to the inner surface of the wrist, and a second portion curved longitudinally for causing the same to be substantially complementary to portions of the palm of the hand.

14. A device as recited in claim 13 in which said second portion includes a longitudinal flange part along one edge for extending over the side edge of the palm of the hand.

15. A device as recited in claim 13 in which said first reinforcing member includes a third portion adjacent said second portion, said third portion having a first substantially flat transverse part, and a second substantially flat part at an angle to said first substantially flat path such that it inclines away from said one side of said first reinforcing member.

16. A device as recited in claim 15 in which said third portion is at one end of said first reinforcing member.

17. A device as recited in claim 16 in which said second and third portions of said first reinforcing member are closer to said thumb opening than is said first portion of said first reinforcing member.

18. A device as recited in claim 8 including in addition a third reinforcing member intermediate said first and second reinforcing members for overlying the outer side edge of the hand and wrist and bracing against outer sideways wrist movement.

19. A device as recited in claim 18 in which said third reinforcing member is sufficiently malleable to be bent by hand to assume a contour substantially complementary to the outer side portions of the hand and wrist of the user of said wrist support.

20. A device as recited in claim 19 in which said sheet means defines three pockets, each of which receives one of said reinforcing members.

21. A device as recited in claim 20 in which said pockets for said second and third reinforcing members are parallel and contiguous, whereby said second and third reinforcing members are held in adjacency and with their longitudinal axes substantially parallel.

22. A device as recited in claim 21 in which said pocket for said first reinforcing member diverges away from said pocket for said third reinforcing member, whereby said first reinforcing member is relatively adjacent said third reinforcing member at one end thereof and spaced from said third reinforcing member at the opposite end thereof.

23. A device as recited in claim 22 in which said second reinforcing member is longer than said third reinforcing member and said third reinforcing member is longer than said first reinforcing member.

24. A device as recited in claim 8 in which said strap means includes three substantially parallel strap members integral with said sheet means at said one end thereof.

25. A device as recited in claim 8 in which
said sheet means includes two sheet members,
the first of said sheet members defining said thumb opening,
said strap means being integral with and extending outwardly from one end of said first sheet member,
the second of said sheet members having an end attached to the opposite end of said first sheet member,
said end of said second sheet member and said opposite end of said first sheet member being concave at intermediate portions,
said concave portions being connected to each other, whereby said first and second members so attached together provide a three-dimensional contour to said first and second sheet members.

26. A device as recited in claim 25 in which said first and second members are so attached together by being sewn to form a plain seam.

27. A device as recited in claim 25 in which
said strap means includes three elongated elements extending outwardly from said one end of said first sheet member,
said elongated elements when in the free position of said first sheet member converging outwardly, and when said edges of said notch are so attached together being substantially parallel.

28. A device as recited in claim 25 in which
said sheet means includes a third sheet member sewn to the inner surfaces of said first and second sheet members at spaced locations intermediate said thumb opening and the outer edge of said second sheet member to cooperate with said first and second sheet members in defining pockets,
said reinforcing members being received in said pockets.

29. A device as recited in claim 25, in which
said thumb opening is adjacent one side edge of said first sheet member,
said first sheet member having a notch extending inwardly from the opposite side edge thereof to said thumb opening,
said notch being defined by edges which are convergent from said opposite side edge to said thumb opening,
said edges of said notch being attached together for providing said first sheet member with a three-dimensional contour.

30. A device as recited in claim 29 in which said edges of said notch are so attached together by being sewn to form a plain seam.

31. A device as recited in claim 8 including a lining of cushioning material overlying the inner surface of said sheet means.

* * * * *

UNITED STATES PATENT AND TRADEMARK OFFICE

CERTIFICATE OF CORRECTION

PATENT NO. : 4,047,250

DATED : September 13, 1977

INVENTOR(S) : BILL NORMAN

It is certified that error appears in the above-identified patent and that said Letters Patent are hereby corrected as shown below:

Column 1, line 44, "oriduces" should be --- produces ---.

Column 1, line 48, "as" should be --- a ---.

Column 3, lines 3 and 4, "velcro" should be --- VELCRO ---

Column 3, line 27, between "of strong" insert --- a ---.

Column 3, line 35, "of" should be --- in ---.

Column 4, line 17, "usd" should be --- used ---.

Column 5, line 36, "recives" should be --- receives ---.

Column 6, line 39, "plam" should be --- palm ---.

Column 6, line 46, "palm" should be --- part ---.

Column 6, line 47, "paln" should be --- palm ---.

Column 6, line 49, "plam" should be --- palm ---.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*